United States Patent [19]

Cheng

[11] Patent Number: 4,756,992

[45] Date of Patent: Jul. 12, 1988

[54] FULL TONE ELECTROPHOTOGRAPHIC IMAGING REPRODUCTION

[76] Inventor: Stephen Po-Ming Cheng, 155 Marlee Ave., Apt. 1006, Toronto, Ontario, Canada, M6B 4B5

[21] Appl. No.: 897,033

[22] Filed: Aug. 15, 1986

Related U.S. Application Data

[63] Continuation-in-part of Ser. No. 638,066, Aug. 6, 1984, and a continuation-in-part of Ser. No. 400,304, Feb. 17, 1983.

[51] Int. Cl.[4] ..... G03G 13/22; G03G 15/26

[52] U.S. Cl. ..... 430/54; 430/902; 430/494; 430/56; 430/55; 118/647; 355/3 BE; 355/3 SH; 355/3 CH; 355/8; 355/14 E

[58] Field of Search ..... 430/55, 56, 54, 494; 118/647; 355/3 BE, 3 CH, 3 SH, 14 E

[56] References Cited

U.S. PATENT DOCUMENTS

| | | | |
|---|---|---|---|
| 2,955,938 | 10/1960 | Steinhilper | 430/31 |
| 3,539,225 | 11/1970 | Goffe | 355/16 |
| 3,549,251 | 12/1970 | Olden | 355/12 |
| 3,598,579 | 8/1971 | Robinson | 430/31 X |
| 3,963,488 | 6/1976 | Bruschenko | 430/31 X |

FOREIGN PATENT DOCUMENTS

| | | |
|---|---|---|
| 1522567 | 11/1972 | Fed. Rep. of Germany . |
| 3139109 | 5/1982 | Fed. Rep. of Germany . |

OTHER PUBLICATIONS

Patent Abstracts of Japan, vol. 4, #78, p-14, [560], Jun. 6, 1980; JP-A-5543566.

*Primary Examiner*—J. D. Welsh

[57] ABSTRACT

A method of producing an electrostatic charge image comprising the sequential steps of: (1) bringing an electrode into proximity with a photoreceptor, the photoreceptor having a dielectric substrate and a photoconductive film intimately bonded to the substrate, the electrode having means to enable an electric field to be applied across the photoreceptor and being adapted to be brought into proximity with the substrate of the photoreceptor along a length of the electrode and charging the photoreceptor with an electrostatic charge of one polarity and projecting an image of a photograph on the receptor, (2) charging the photoreceptor with an electrostatic charge of opposite polarity, and (3) projecting a photographic image of the subject again on the photoreceptor whereby an electrostatic charge image is formed on the photoconductor surface. The invention also resides in apparatus to carry out the method.

In another respect the invention consists, in an electrostatic image system of photoreproduction, of (1) a photoreceptor comprising a dielectric substrate and a photoconductive film intimately bonded to the substrate; and (b) field application means having (1) a dielectric layer adapted to be brought into intimate contact with the substrate of the photoreceptor along a length of the electrode and (2) means to enable an electric field to be applied across the photoreceptor and adapted to be brought into proximity with the substrate of the photoreceptor along a length of the electrode.

32 Claims, 10 Drawing Sheets

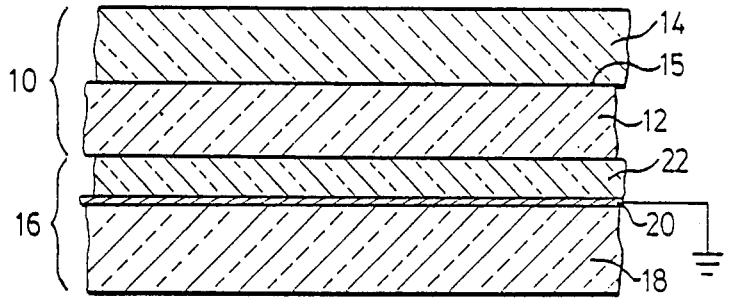
FIG. 1
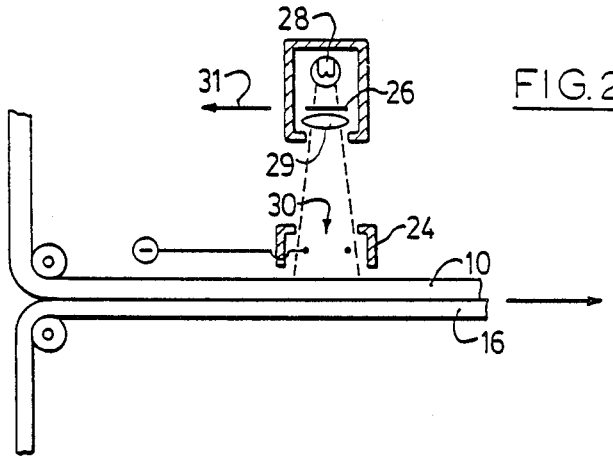
FIG. 2a
FIG. 2b
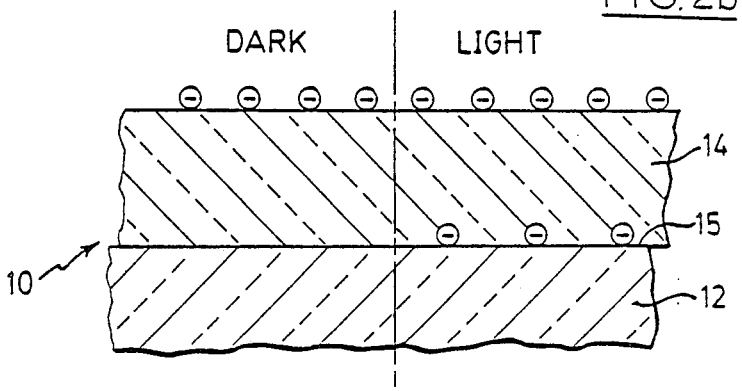

FIG. 12
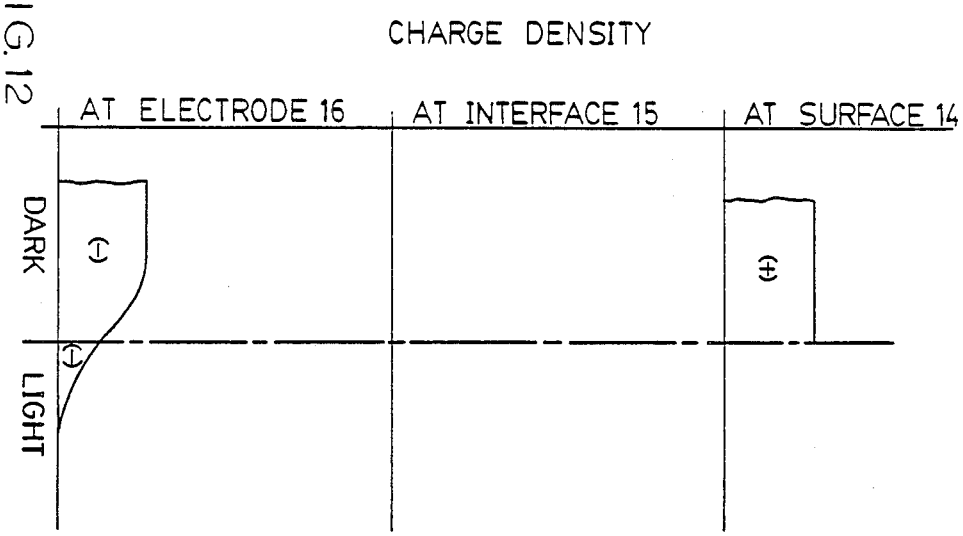
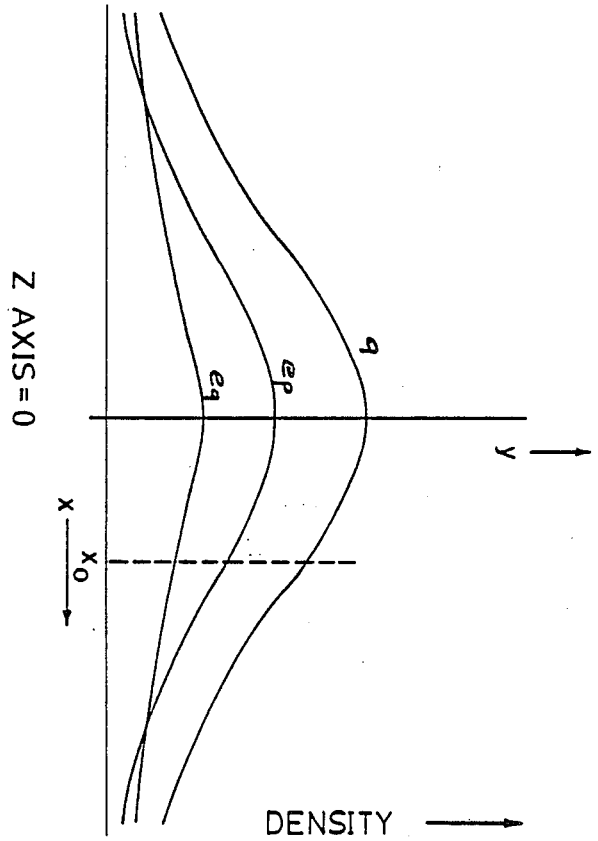
FIG. 14

FULL TONE ELECTROPHOTOGRAPHIC IMAGING REPRODUCTION

This application is a continuation-in-part of U.S. patent application Ser. No. 638,066 filed Aug. 6, 1984, and a continuation-in-part of U.S. patent application Ser. No. 400,304, filed Feb 17, 1983.

FIELD OF THE INVENTION

This invention relates to photoreproduction using the system known as xerography.

In the xerographic system a latent electrostatic image is created on a photoconductor surface to which charged toner material is subsequently applied, transforming the electrostatic image into a visual image. The toner is then transferred onto a sheet and fused to it. To create the electrostatic image the subject is first projected onto a charged photoreceptor which receives the latent image as a charge density varying over its surface according to the light intensity projected by the subject, the area receiving less light having a higher charge density. This charge density pattern is developed by applying charged toner material and the toner material is transferred to a charged dielectric sheet.

A problem of this system is the presence of a transition zone at the boundaries between areas of differing charge densities corresponding to abrupt changes between light and dark areas of the visual image, giving an "edge enhanced" or gray area of reproduction at such boundaries.

It is an object of the present invention to provide a method and apparatus for obtaining a photoreproduction of improved clarity by sharpening abrupt boundary lines between light and dark areas of a visual image.

It is a further object of the invention to provide a method and apparatus for obtaining a photoreproduction having gradation of darkness corresponding more correctly with the subject matter being reproduced.

Another object of the invention is to provide a method and apparatus for obtaining photoreproduction having an electrostatic field of increased strength, allowing the use of toner particles of smaller size and therefore as reproduction of finer grain and resolution.

SUMMARY OF THE INVENTION

Essentially the invention consists of a method of producing an electrostatic charge image comprising the sequential steps of: (1) bringing an electrode into proximity with a photoreceptor, the photoreceptor having a dielectric substrate and a photoconductive film intimately bonded to the substrate, the electrode having means to enable an electric field to be applied across the photoreceptor and being adapted to be brought into proximity with the substrate of the photoreceptor along a length of the electrode and charging the photoreceptor with an electrostatic charge of one polarity and projecting an image of a photograph on the receptor, (2) charging the photoreceptor with an electrostatic charge of opposite polarity and (3) projecting a photographic image of the subject again on the photoreceptor whereby an electrostatic charge image is formed on the photoconductor surface. The invention also resides in apparatus to carry out the method.

In another aspect the invention consists, in an electrostatic image system of photoreproduction, of (a) a photoreceptor comprising a dielectric substrate and a photoconductive film intimately bonded to the substrate; and (b) field application means having (1) a dielectric layer adapted to be brought into intimate contact with the substrate of the photoreceptor along a length of the electrode and (2) means to enable an electric field to be applied across the photoreceptor and adapted to be brought into proximity with the substrate of the photoreceptor along a length of the electrode.

One preferred embodiment includes the steps of charging the photoreceptor with an electrostatic charge of one polarity and projecting a preselected off-focus image of the subject on the receptor subsequent to the first projection of the image and again subsequent to charging the photoreceptor with an electrostatic charge of opposite polarity.

BRIEF DESCRIPTION OF THE DRAWINGS

An example embodiment of the invention is shown in the accompanying drawings in which:

FIG. 1 is a cross-sectional view of a photoreceptor and electrode;

FIG. *2a* is a schematic diagram of the first step in photoreproduction using the photoreceptor and electrode of FIG. 1;

FIG. *2b* is a schematic diagram showing the migration of negative charge to the interface in the photoreceptor;

FIG. *2c* is a schematic diagram showing the relative distribution of charge density effected by the step of FIG. *2a;*

FIG. *3a* is a schematic diagram showing the second step in photoreproduction using the photoreceptor and electrode of FIG. 1;

FIG. *3b* is a schematic diagram showing the relative distribution of charge density effected by the step of FIG. *3a;*

FIG. *4a* is a schematic diagram showing the third step in photoreproduction using the photoreceptor and electrode of FIG. 1;

FIG. *4b* is a schematic diagram showing the relative distribution of charge density effected by the step of *4a;*

Figure 5:
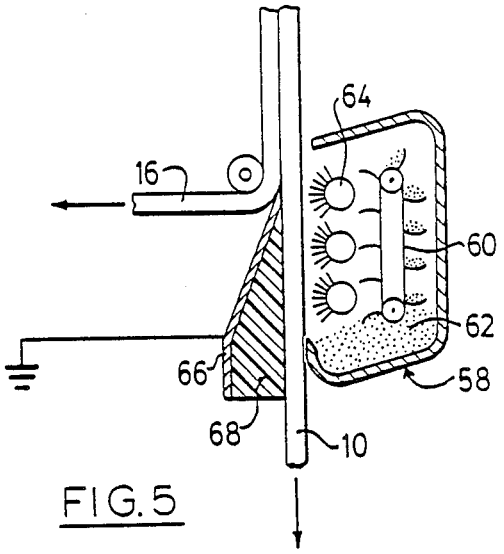
Figure 6:
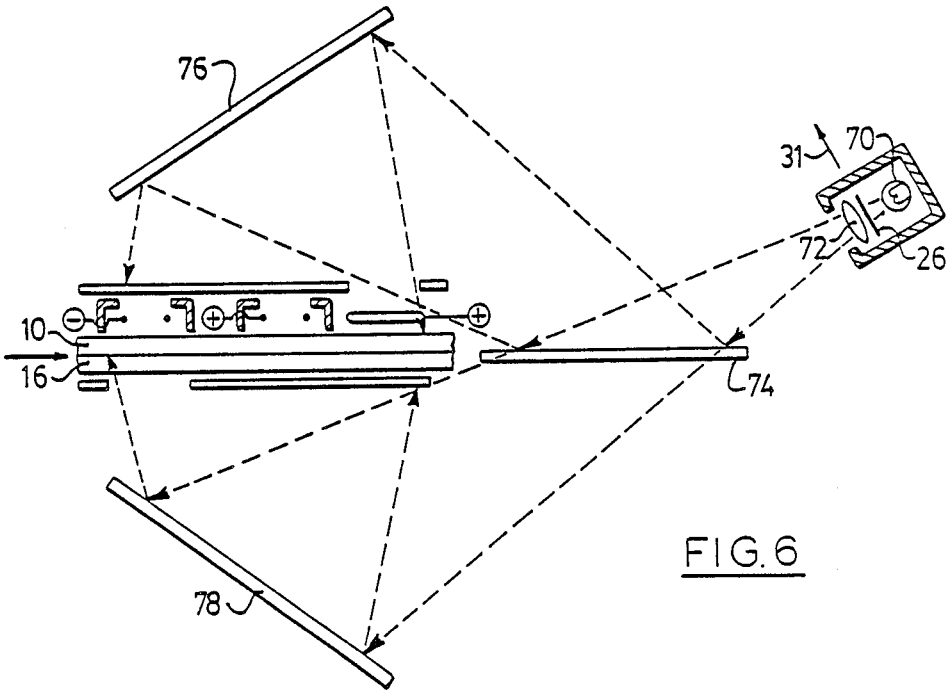
Figure 9B:
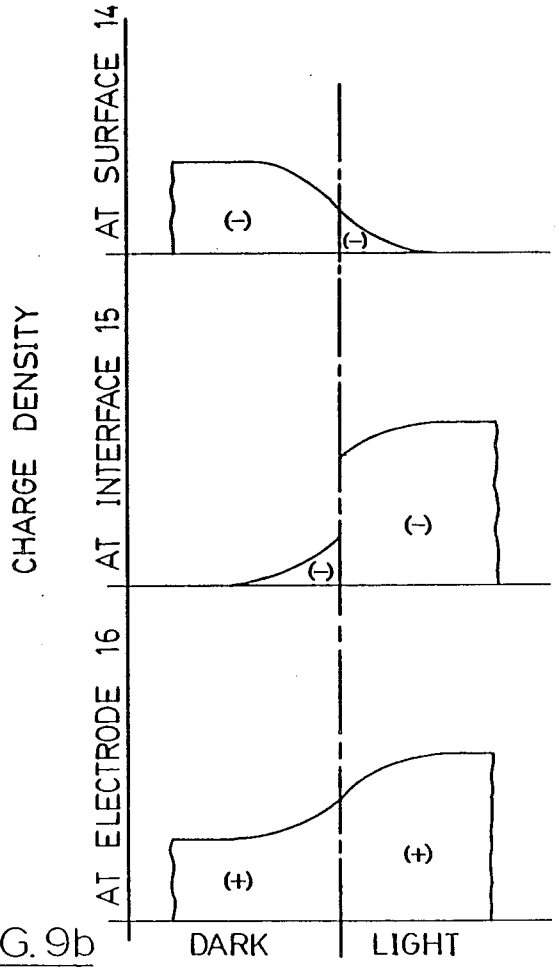

FIG. 5 is a schematic diagram showing the fourth step in photoreproduction using the photoreceptor and electrode of FIG. 1;

FIG. 6 is a schematic view showing the method of projection of an image onto both sides of a photoreceptor.

Figure 7:
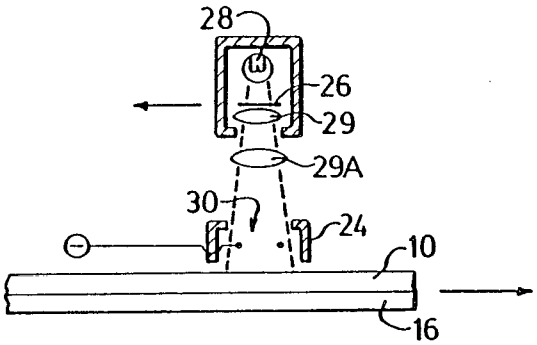
Figure 8:
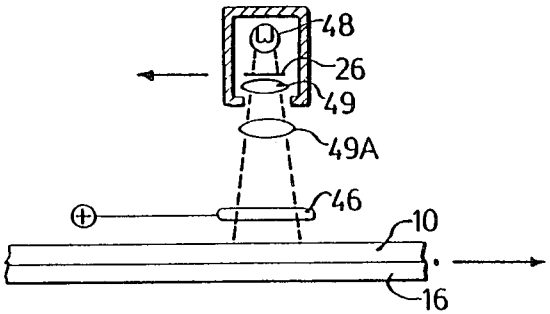
Figure 9A:
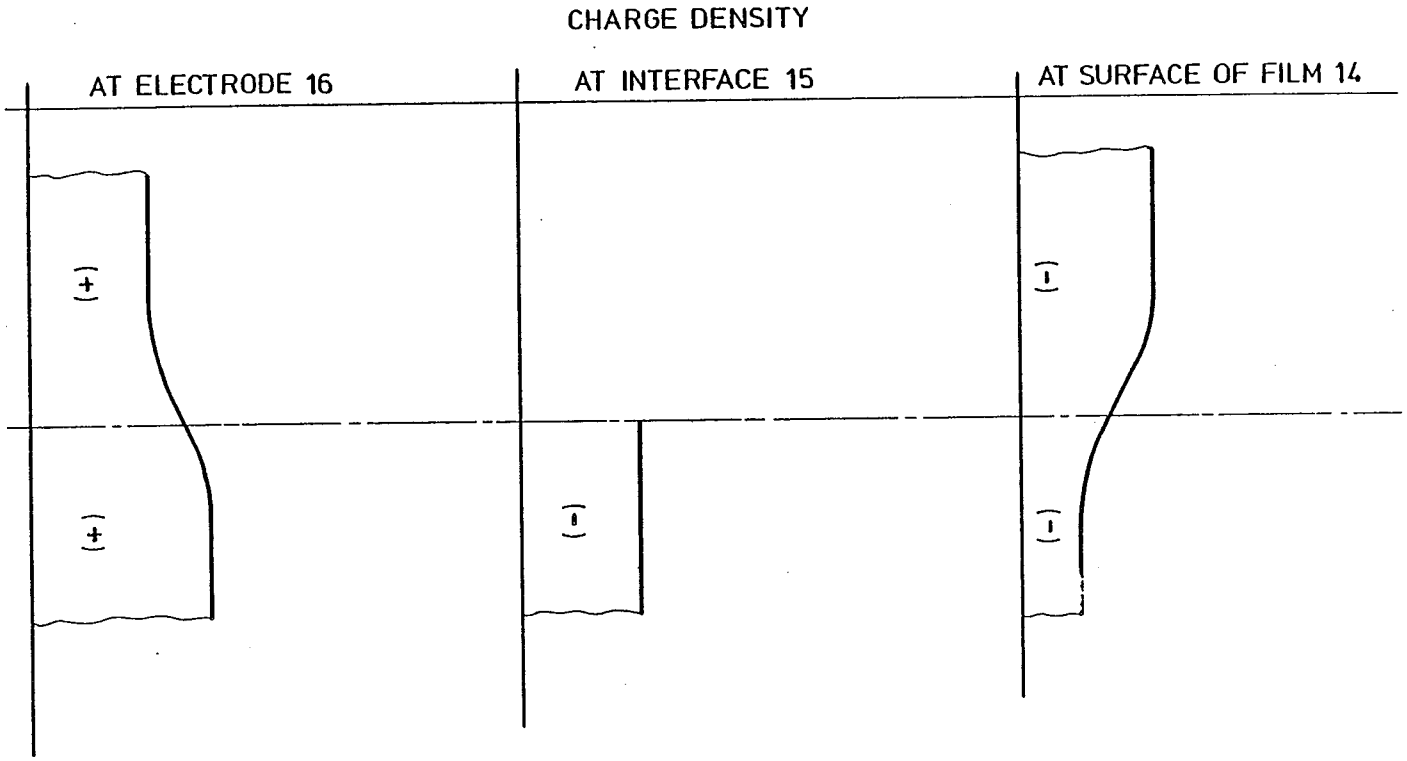
Figure 10:
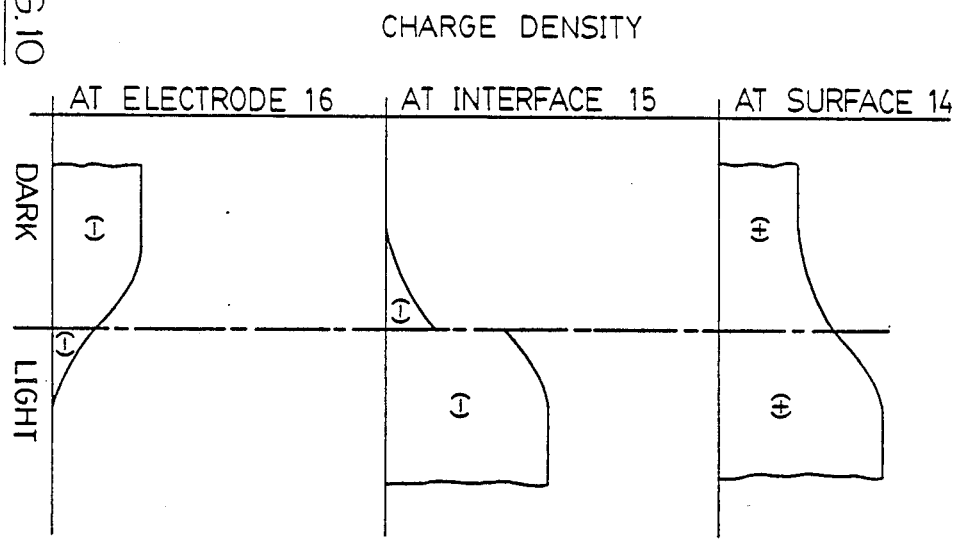
Figure 11:
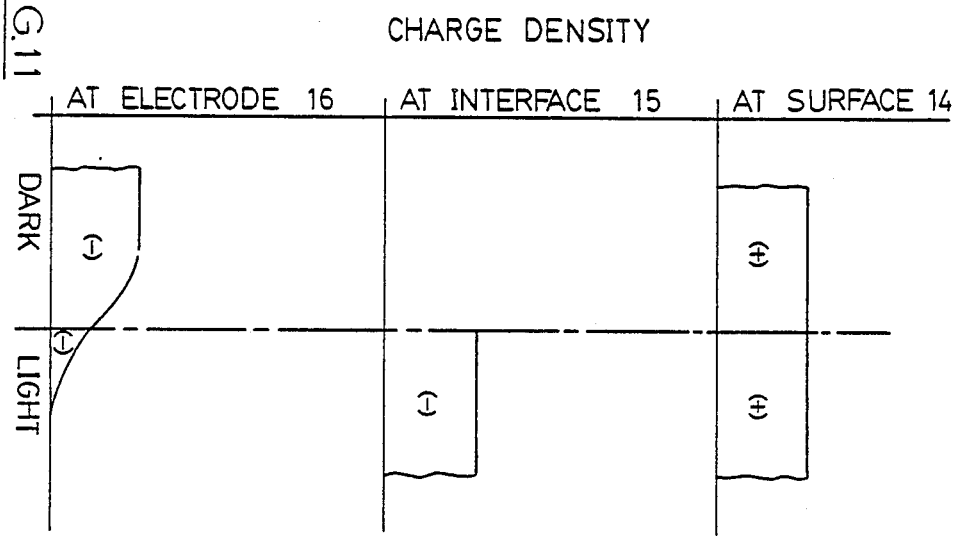
Figure 13:
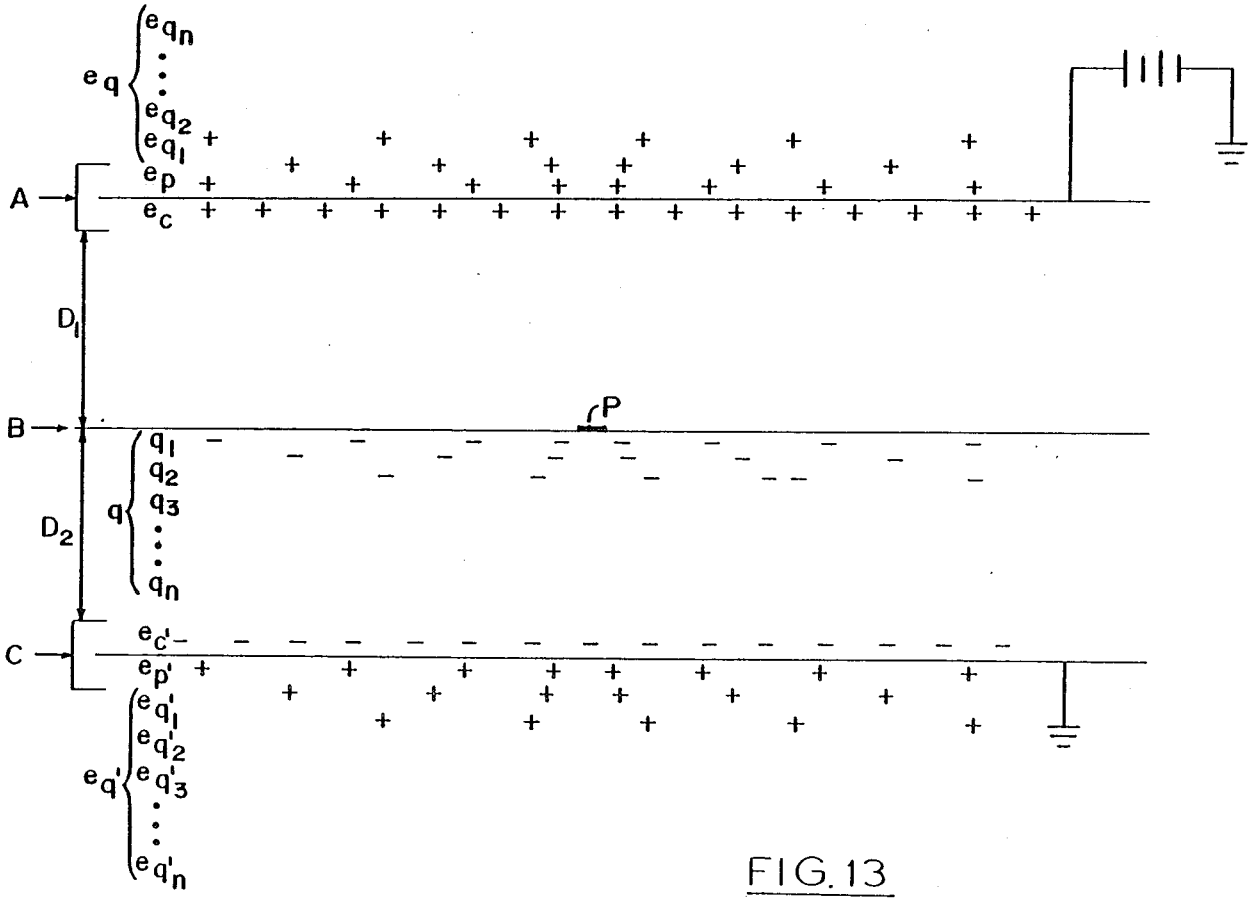

FIGS. 7 and 8 are schematic diagrams showing an alternate embodiment of the invention;

FIGS. 9 to 12 are schematic diagrams showing the relative distribution of charge density in the alternate embodiment of FIGS. 7 and 8;

FIGS. 13 and 14 are schematic diagrams relating to the theoretical basis for the alternate embodiment of FIGS. 7 and 8.

Figure 15:
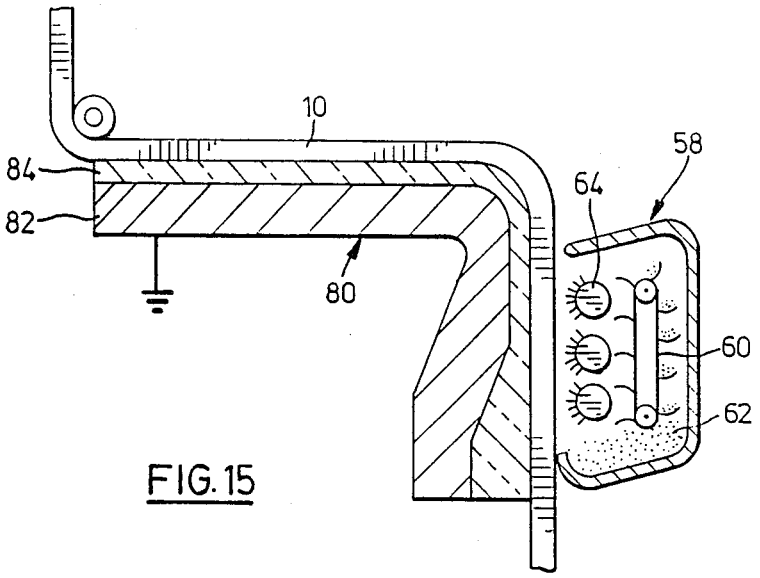
Figure 16:
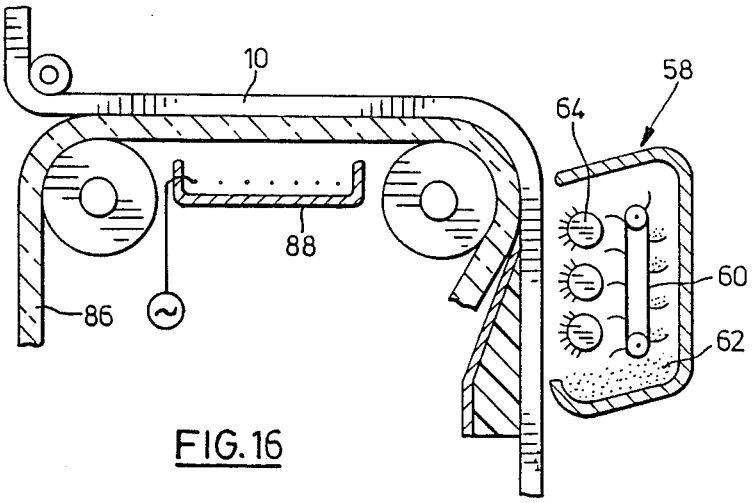

FIG. 15 is a schematic diagram similar to FIG. 5 showing an alternate embodiment apparatus; and FIG. 16 is a schematic diagram similar to FIG. 5 showing another alternate embodiment.

DESCRIPTION OF PREFERRED EMBODIMENTS

The example embodiment shown in FIG. 1 of the drawings comprises (a) a photoreceptor 10 having a dielectric substrate 12 and a photoconductive film 14 intimately bonded to the substrate with an interface 15, and (b) an electrode 16 having a lower belt 18 of flexible material, an intermediate conductive film 20 intimately bonded to belt 18 and grounded, and an upper layer 22 of dielectric material bonded to film 20. Photoreceptor 10 and electrode 16 are capable of being brought into intimate contact as shown in FIG. 1 and the following material and thicknesses are preferred:

| element | material | thickness |
|---|---|---|
| substrate 12 | polyester (Mylar, Teflon) | 25–150 um |
| film 14 | amorphous silicon (a - Si:H) | 25–150 um |
| belt 18 | polyester (Mylar, Teflon, aluminum) | |
| film 20 | Al, CuI | 100–500 Angstroms |
| layer 22 | $Si_3N_4$, polyester (Mylar, Teflon) | 1000 Angstroms-5 um |

Substrate 12 and photoconductive film 14 are preferably of equal capacitance. If belt 18 is made of a conductive metal such as aluminum, intermediate conductive film 20 may be omitted.

An example embodiment of the method of the invention is shown in FIGS. 2 to 6 of the drawings. In the first step of the example method photoreceptor 10, together with electrode 16, is passed beneath a corona charge station 24 which is connected to a source of negative electrical potential. An image 26 to be photocopied is projected by a light source 28 by means of a lens 29 onto photoconductive film 14 of photoreceptor 10 through an opening 30 in corona charge station 24 as seen in FIG. 2*a*. Image 26 is scanned at the same rate of speed as the movement of photoreceptor 10, as indicated by arrow 31. The result of this projection is the migration of negative ions, in those areas of photoreceptor 10 subjected to light impingement, through film 14 to interface 15 where the negative charge is trapped, as seen in FIG. 2*b*. In FIG. 2*c*, the relative distribution of the charge density is indicated at the surface of film 14 (negative) by numeral 32, at interface 15 (negative) by numeral 34 and in electrode 16 (positive) by numeral 36, the positive charge distribution in electrode 16 being induced by the negative charge at interface 15 and at surface of film 14.

Figure 3A:
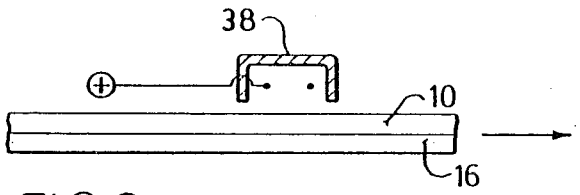
Figure 3B:
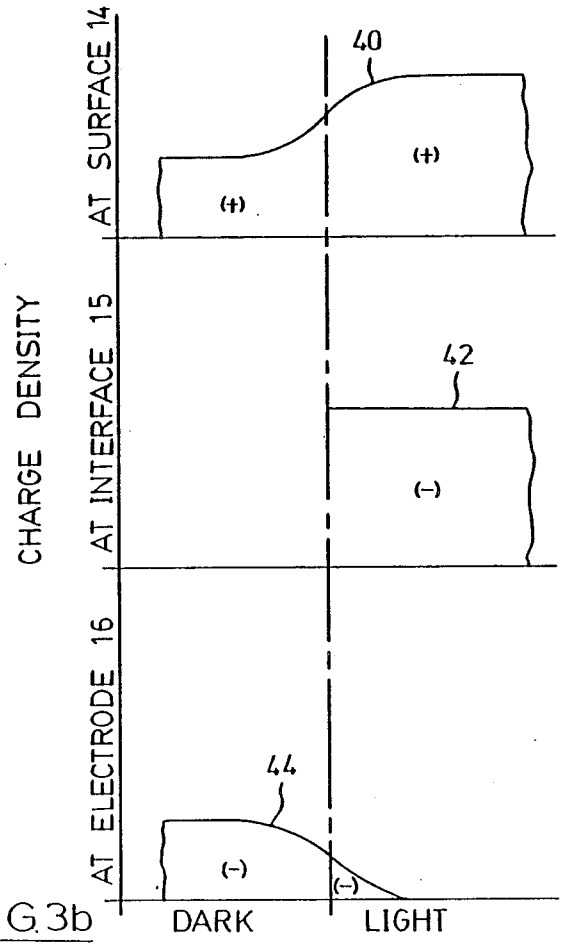

In the next step photoreceptor 10, together with electrode 16, is passed beneath a corona charge station 38 which is connected to a source of positive electrical potential, as seen in FIG. 3*a*, resulting in a relative distribution of charge density as seen in FIG. 3*b*, which shows a positive charge 40 at the surface of film 14, a negative charge 42 at interface 15 and a negative charge 44 at electrode 16.

Figure 4A:
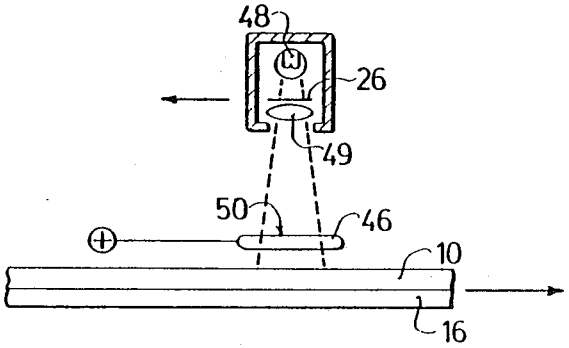
Figure 2C:
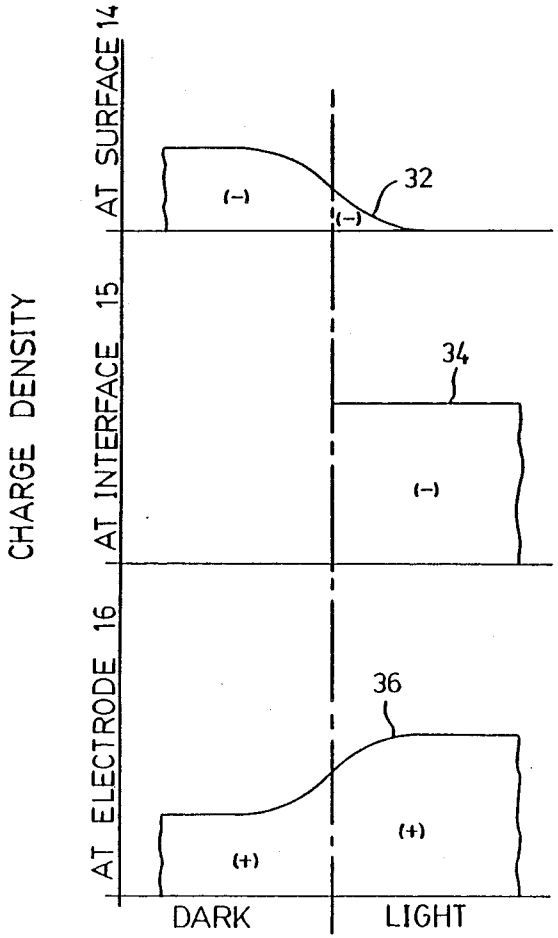
Figure 4B:
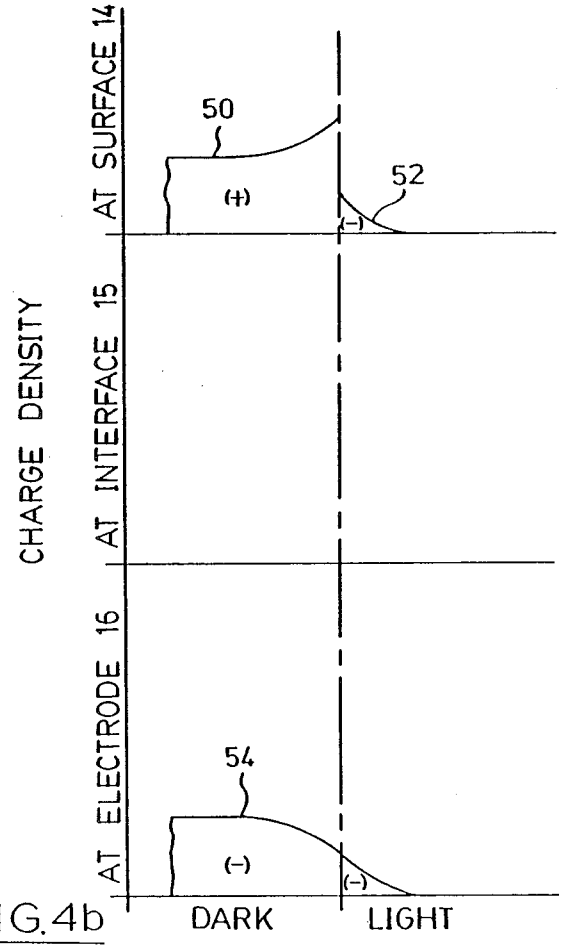

In the next step photoreceptor 10 and electrode 16 are passed beneath a transparent high voltage booster station 46 connected to a source of positive electrical potential and image 26 is again projected by a light source 48 and a lens 49 onto photoconductive film 14 of photoreceptor 10, as seen in FIG. 4*a*. The result of this projection is seen in the relative distribution of charge density seen in FIG. 4*b*, which shows a positive charge 50 in the dark area of the surface of film 14 and a negative charge 52 in the light area of the surface of the film, no charge at interface 15, and a negative charge 54 at electrode 16. The function of high voltage booster station 46 is preferred to help achieve a faster discharge rate.

After photoreceptor 10 is given its second exposure to the image, as described with respect to FIG. 4, toner material is applied in known manner as shown in FIG. 5. A developer housing 58 encloses a bucket conveyor 60 which delivers developer 62 consisting of positively charged carrier and negatively charged powdered toner material to a plurality of magnetic brushes 64 which sweep over film 14 of photoreceptor 10, while at the same time electrode 16 is peeled away from the back of the photoreceptor. A grounded electrode 66 is positioned adjacent substrate 12 of photoreceptor 10 at an angle to the photoreceptor whereby the distance between the substrate 12 and electrode 66 increases from the point of separation of electrode 16 from the photoreceptor. The presence of electrode 66 serves to enhance the contrast of the developed image on the photoreceptor.

As electrode 16 is peeled off from the back of substrate 12 it is replaced by a solid plastic support 68, which carries conductive electrode 66 at its outer surface. Support 68 is slightly conductive, about $10^{15}$ ohm-cm, so that any static charge accumulated by rubbing against substrate 12 is discharged. As photoreceptor 10 moves down, the charge latent image surface moves further and further away from electrode 66. This tends to increase the electric field intensity inside the development system. However, on the other hand, the deposition of toner particles on the image surface tends to decrease the electric field intensity. By suitably designing the angle of the edge of support 68 it is possible to achieve a condition that the increase in field intensity is exactly balanced by the decrease caused by the deposition of toner particles. As a result the electric field intensity is kept constant inside the development system. This prevents an excessive strong electric field buildup inside the development system which would cause "arcing" between the image charge and brushes 64. At the end of the development procedure the latent image charge is complete neutralized by the deposited toner particles. The developed image can then be transferred and fixed. If the photoreceptor itself is used as a permanent image recipient, such as zinc oxide coated paper, the transfer process can be omitted. It can be seen that the function of conductive layer 20 is to enable an electric field to be applied across photoreceptor 10 and the function of dielectric layer 22 is to prevent charge ions from being attached to the substrate when the electrode is peeled away.

Some photoreceptive materials, for example selenium, conduct positive charges when light activated. FIG. 6 shows the arrangement required for light impingement on electrode 16 as well as on photoreceptor 10 to achieve the same result as in the previous embodiment. In this case image 26 is projected by a light source 70 and a lens 72 onto a mirror 74, splitting it into two images which are projected by a mirror 76 and a mirror 78 onto the upper and lower surfaces, respectively, of photoreceptor 10, thus causing the positive ions to migrate to the upper surface of film 14, leaving behind a negative charge density as seen in FIG. 2*b*. This split image procedure is only necessary in the first step shown in FIG. 2*a*. In this case both electrode 16 and substrate 10 are made of transparent material.

Bipolar photoconductors 14 are most suitable for this invention. The common bipolar photoconductors are amorphous silicon (a - Si:H), ZnO treated with urazole or $H_2S$, or its resin containing Mn or other additives, various organic photoconductors containing certain substituted cycloheptenyl compounds and organic photoconductors comprising a halogen-ketone-formaldehyde resin. Single-polar photoconductors such as amorphous selenium (as mentioned above) and most organic photoconductors can also be used in this invention. Two techniques can be used to solve the single-polar conducting problem. One is a transparent base electrode 16 which permits rear exposure. The second technique is adding a layer of lower-energy-gap material at interface 15. The lower-energy-gap material can be crystal selenium or the like in the form of small insulated dots of 10–20 um in size and spaced 5 um apart. Then use red or other low energy light in the on-focus and off-focus negative charge injection process. The red light or other low energy light can penetrate the photoconductor layer and reaches the lower-energy-gap layer. Carriers will be produced on absorption of red light photons by the lower-energy-gap layer. Carriers produced at the interface region migrate back through the photoconductor layer to the surface.

It will be appreciated that the latent image formed by the method of this invention will have a varying degree of charge density in exact proportion to the opacity pattern of the actual image. Thus either line images of only black and white or images being varying degree of greyness between these two extremes may be reproduced faithfully. Also because of the strong electric field inside the development system extremely high resolution can be achieved.

Of course the method of the invention may be carried out using a positive charge in the step of FIG. 2*a* followed by a negative charge in the steps of FIGS. 3*a* and 4*a*.

In the charge process because light area has a negative charge trapped at interface 15 the charge density on the surface of film 14 will be higher in the light area than in the dark area (see FIG. 3*b*). At the boundary between light and dark areas there is a transition zone about 1/16 of an inch in which the charge density changes gradually. There is a higher charge density at the image edge and consequently this causes an "edge enhanced" copy (see FIG. 4*b*). This is not desirable in many imaging applications where solid area development is desired, such as a picture. The use of an off-focus lens minimizes this undesirable "edge enhanced" effect.

To explain the off-focus process reference is made to FIGS. 13 and 14. In FIG. 13 two electrodes A and C are separated by two dielectrics D1 and D2. B is the interface between the two dielectrics. For the sake of simplicity let the electrical capacitance between AB and the capacitance between BC have the same value and let them be named C1 and C2 respectively. A D.C. voltage source is connected to electrode A while electrode C is grounded. A uniform positive charge $e_c$ of charge density Rc appears on electrode A and a uniform negative charge $e_{c'}$ appears on electrode C. Now place a small point charge p at interface B which is negative and whose charge density Rp is equal to Rc. Thus Rp and Rc are equal but opposite in polarity. Because of the introduction of negative charge p, induced positive charges $e_p$ and $e_p$, will appear in electrodes A and C respectively. These induced charges $e_p$ and $e_p$, tend to distribute in such a way that there is more concentration at a location close to p than further away from p. A mathematical formula can be produced which can calculate the exact charge distribution. Because the capacitance C1 and C2 are equal, then the relationship $e_p = e_{p'}$, $= \frac{1}{2}p$ exists. Now place another charge $q_1$ at the interface B directly underneath $e_p$. Charge $q_1$ is equal and opposite in polarity to $e_p$. The charge distribution of $q_1$ is exactly the same as $e_p$. Again there will be induced positive charges $e_{q1}$ and $e_{q1}$ on A and C respectively. The same mathematical formula can calculate the exact charge distribution of $e_{q1}$. We also have the relationship $e_{q1} = \frac{1}{2}q_1$. Here again we can place a negative charge $q_2$ at interface B underneath $e_{q1}$ which is equal and opposite to $e_{q1}$ and has exactly the same charge distribution. The process can be repeated many many times until the induced charge $e_{qn}$ is so small that it can be negligible. Let $e_q = e_{q1} + e_{q2} + \ldots + e_{qn}$ and $q = q_1 + q_2 + q_3 + \ldots + q_n$. FIG. 14 shows the curves of q, $e_q$ and $e_p$ with the Z axis equal to zero. We have the relationship $$F(q_{(x0,z0)}) = F(e_{q(x_0,z_0)}) + F(e_{p(x_0,z_0)})$$

at any point $x_0,z_0$ on on the plane X,Z. Mathematically we have the relationship:

$$q = p(1/x + 1/x^2 + 1/x^3 + \ldots + 1/x^n) \text{ for } X > 1$$

$$\text{where } x = \frac{\text{capacitance } C1 + C2}{\text{capacitance } C1}$$

In this example since C1 equals C2, x equals 2.

$$\text{Since } \sum_{n=1}^{\infty} 1/x^n = 1/x + 1/x^2 + 1/x^3 + \ldots + 1/x^n = 1/(x-1).$$

$$\text{We have } q = p/(x-1) = p(C1/C2).$$

In the case of the present invention D1 is photoconductive layer 14. D2 is dielectric substrate 12. C1 is the capacitance of photoconductive layer 14. C2 is the capacitance of dielectric substrate 12. A is the surface of photoconductor 14. B is interface 15 between the photoconductor and the substrate. C is intermediate conductive film 20. Charge p is the injected negative charge at interface 15. Charge q is the off-focus injected negative charge at interface 15. Charges $e_c$, $e_p$ and $e_q$ are placed on the surface of photoconductor 14 by positive charging station 38. $e_c$ is caused by the potential applied to the charging station 38. Charges $e_p$ and $e_q$ are caused by the grounding effect of charging station 38. In the off-focus exposure process $e_p$ and $e_q$ will move down to cancel q. In the subsequent exposure process that part of the $e_c$ charge above p will move down to cancel p. Thus a point is discharged on the surface of the photoconductor 14. A latent image is formed by summing up all the points.

An off-focus lens can be defined as a lens which has a special light diffusion such that when it is applied to this electrophotographic imaging system, the light from any one point of the original image can be diffused to the photoconductor surface in such a way that the light intensity distribution on the photoconductor is in the same shape as the charge distribution of the function $F(q_{(x,z)})$ calculated above. As a result we can achieve the desired condition that $$F(q_{(x0,z0)}) = F(e_{p(x_0,z_0)}) + F(e_{q(x_0,z_0)})$$

at any point $x_0,z_0$ of the photoconductor surface. The preselected off-focus image is formed by projecting an image through this off-focus lens.

The on-off focus ratio is a measure of ratio of the amount of light photons directed to the photoconductor surface during the two processes (on focus and off focus). For complete elimination of the "edge enhanced" effect the ratio is equal to p/q, which in turn equals C2/C1, as proved above. In some copying requirements a certain amount.of "edge enhanced" effect is desirable such as in art work. In this case the on-off focus ratio can be adjusted to be greater than p/q to achieve the desired amount of "edge enhanced" effect.

Referring now to FIGS. 7 and 8 of the drawings, an off-focus lens 29*a* is added to the apparatus of FIG. 2*a* as seen in FIG. 7, and image 26 is projected onto photoconductor 10 as an added step between the step of FIG. 2*a* and the step of FIG. 3*a*. Subsequently, an off-focus lens 49*a* is added to the apparatus of FIG. 4*a*, as seen in FIG. 8, and image 26 is projected onto photoconductor 10 as an added step between the step of FIG. 3*a* and the step of FIG. 4*a*. The relative densities resulting from each of the sequential steps of FIGS. 2*a*, 7, 3*a*, 8 and 4*a* are shown in FIGS. 9*a*, 9*b*, 10, 11 and 12, respectively.

The alternate embodiment shown in FIGS. 15 and 16 show other means to enable an electric field to be applied across photoreceptor 10. In FIG. 15 photoreceptor 10 slides over a fixed electrode 80 comprising a grounded conductive substrate 82 having intimately bonded to its upper surface a dielectric coating 84. Fixed electrode 80 performs the same function as support 68 of FIG. 5 In FIG. 16 photoreceptor 10 travels with a belt 86 of dielectric material which passes over a corona charge station 88 which is connected to an alternating, high voltage electrical source, belt 86 and charge station 88 forming an electrode. The method using either of these alternate embodiments is the same as that using the structure of FIG. 5. A suitable lubricant can be applied to the dielectric of electrode 80 in FIG. 15 to decrease the friction of sliding photoreceptor 10.

It is known that an electrostatic image can be exposed by using a modulated scanning laser beam, such as in a laser printer. In some more advanced machines a picture of various tone levels can also be produced. In the applicant's present system the method of exposing an image by using modulated scanning laser beams can also be applied. In such application the steps of projecting a photographic image are replaced by the steps of projecting a modulated scanning laser beam. Also the steps of projecting a preselected off-focus image are replaced by the steps of projecting a modulated scanning preselected off-focus laser beam. The result is that an electrostatic image is formed on the photoconductor surface in the same manner as using photographic image projection method. A modulated scanning laser is actually discharging one point at a time and an image is formed by summing up all the points. Another important application of using laser beam is high density laser recording. One objective of the present invention is that an extemely high resolution image can be developed. An image of the order of 800 line pairs per millimeter can be developed by using liquid developer. In such an application two 1 micron width modulated scanning laser beams are used, one being used for the negative charge injection step and the other being used for the exposure step. The developed image can contain one billion bits of data (on or off signal) in an area of 5 cm×8 cm which is the size of a credit card.

I claim:

1. A method of producing an electrostatic charge image comprising the sequential steps of:

(1) bringing an electrode into proximity with a photoreceptor, the photoreceptor having a dielectric substrate and a photoconductive film intimately bonded to the substrate, the electrode having means to enable an electric field to be applied across the photoreceptor and being adapted to be brought into proximity with the substrate of the photoreceptor along a length of the electrode and charging the photoreceptor with an electrostatic charge of one polarity and projecting an image of a photograph on the photoreceptor, (2) charging the photoreceptor with an electrostatic charge of opposite polarity, and (3) projecting a photographic image of the subject again on the photoreceptor whereby an electrostatic charge image is formed on the photoconductor surface.

2. A method of producing an electrostatic charge image as claimed in claim 1 including the step of: (4) moving the electrode away from the photoreceptor, whereby to increase the electric field above the photoconductor surface.

3. A method as claimed in claim 1 including the steps of charging the photoreceptor with an electrostatic charge of one polarity and projecting a preselected off-focus image of the subject prior to charging the photoreceptor with an electrostatic charge of opposite polarity and again projecting a preselected off-focus image of the subject on the photoreceptor after the charging step.

4. A method as claimed in claim 1 in which said one polarity is negative and said opposite polarity is positive.

5. A method as claimed in claim 1 in which said one polarity is positive and said opposite polarity is negative.

6. A method as claimed in claim 1 in which both the substrate of the photoreceptor and the electrode are transparent and including the step of projecting the image both on the photoreceptor and on the electrode.

7. A method as claimed in claim 1 including the additional steps of:

(4) moving the electrode away from the photoreceptor and applying particulate toner material carrying a charge of said one polarity to the photoconductive film of the photoreceptor, (5) charging a sheet of material with an electrostatic charge of said opposite polarity and applying the sheet to the photoconductive film of the photoreceptor, (6) removing the sheet from the photoreceptor, and (7) fusing the toner material on the sheet whereby the reproduction of the photographic image is fixed thereon.

8. A method as claimed in claim 7 including the steps of charging the photoreceptor with an electrostatic charge of one polarity and projecting a preselected off-focus image of the subject on the photoreceptor prior to charging the photoreceptor with an electrostatic charge of opposite polarity and again projecting a preselected off-focus image of the subject on the photoreceptor after the charging step.

9. A method as claimed in claim 7 in which said one polarity is negative and said opposite polarity is positive.

10. A method as claimed in claim 7 in which said one polarity is positive and said opposite polarity is negative.

11. A method as claimed in claim 7 in which both the substrate of the photoreceptor and the electrode are transparent and including the step of projecting the image both on the photoreceptor and on the electrode.

12. In an electrostatic image apparatus of photoreproduction:

(a) a photoreceptor comprising a dielectric substrate and a photoconductive film intimately bonded to the substrate; and (b) field application,means having (1) a separable dielectric layer adapted to be brought into intimate contact with the substrate of the photoreceptor along a length of the susbstrate and (2) means to enable an electric field to be applied across the photoreceptor and adapted to be brought into proximity with the substrate of the photoreceptor along a length of the electrode.

13. An electrostatic image apparatus as claimed in claim 12 in which the field application means comprises an electrode comprising a dielectric belt and a charge station behind the belt.

14. An electrostatic image apparatus as claimed in claim 12 in which the field application means comprises an electrode having a fixed and grounded conductive substrate and a dielectric coating intimately bonded to the substrate.

15. An electrostatic image apparatus as claimed in claim 12 in which the field application means comprises an electrode having a lower belt of flexible material, an intermediate conductive film intimately bonded to the belt and grounded, and an upper layer of dielectric material bonded to the conductive film.

16. An apparatus as claimed in claim 15 in which the photoconductive film is amorphous silicon and the substrate is a polyester resin.

17. An apparatus as claimed in claim 16 in which the belt is a polyester resin, the conductive film is copper iodide and the upper layer is silicon nitride.

18. A system as claimed in claim 17 in which the thickness of the photoconductive film of the photoreceptor is 25–150 μm, the thickness of the conductive film of the electrode is 100–500 Angstroms, and the thickness of the upper layer of the electrode is 1000 Angstroms–5 um.

19. An apparatus as claimed in claim 15 in which the electrode is transparent and the substrate of the photoreceptor is transparent.

20. In an electrostatic image apparatus of photographic reproduction of a subject:

(a) a photoreceptor having a dielectric substrate and a photoconductive film intimately bonded to the substrate:

(b) An electrode having means to enable an electric field to be applied across the photoreceptor and being adapted to be brought into proximity with the substrate of the photoreceptor along a length of the electrode;

means sequentially (1) to bring the electrode into proximity with the photoreceptor and to charge the photoreceptor with an electrostatic charge of one polarity and to project a photographic image of the subject on the photoreceptor whereby a charge is injected on the interface between the photoconductive film and the substrate, (2) to charge the photoreceptor with an electrostatic charge of opposite polarity, and (3) to project a photographic image of the subject again on the photoreceptor whereby an electrostatic charge image is formed on the photoconductor surface.

21. An electrostatic image apparatus of photographic reproduction of a subject as claimed in claim 20 including (4) means to move the electrode away from the photoreceptor, whereby to increase the electric field above the photoconductor surface.

22. An apparatus as claimed in claim 20 including means to charge the photoreceptor with an electrostatic charge of one polarity and to project a preselected off-focus image of the subject on the photoreceptor prior to charging the photoreceptor with an electrostatic charge of opposite polarity and again to project a preselected off-focus image of the subject on the photoreceptor after the charging step.

23. An apparatus as claimed in claim 20 in which said one polarity is negative and said opposite polarity is positive.

24. An apparatus as claimed in claim 20 in which said one polarity is positive and said opposite polarity is negative.

25. An apparatus as claimed in claim 20 in which the substrate of the photoreceptor and the electrode are transparent, and including means to project the image both on the photoreceptor and on the electrode.

26. An apparatus as claimed in claim 20 including means to charge the photoreceptor with an electrostatic charge of one polarity and to project a preselected off-focus image of the subject on the photoreceptor during the first projection of the image and again to project a preselected off-focus image of the subject on the photoreceptor during the second projection of the image.

27. An electrostatic image apparatus of photographic reproduction of a subject comprising:

(a) a photoreceptor having a dielectric substrate and a photoconductive film intimately bonded to the substrate;

(b) An electrode having means to enable an electric field to be applied across the photoreceptor and being adapted to be brough into proximity with the substrate of the photoreceptor along a length of the electrode;

means sequentially (1) to bring the electrode into proximity with the photoreceptor and to charge the photoreceptor with an electrostatic charge of one polarity and to project a photographic image of the subject on the photoreceptor whereby a charge is injected on the interface between the photoconductive film and the substrate, (2) to charge the photoreceptor with an electrostatic charge of opposite polarity, (3) to project a photographic image of the subject again on the photoreceptor, (4) to move the electrode away from the photoreceptor and to apply particulate toner material carrying a charge of said one polarity to the photoconductive film of the photoreceptor, (5) to charge a sheet of material with an electrostatic charge of said opposite polarity and to apply the sheet to the photoconductive film of the photoreceptor, (6) to remove the sheet from the photoreceptor, and (7) to fuse the toner material on the sheet whereby the reproduction of the photographic image is fixed thereon.

28. An apparatus as claimed in claim 27 including means to charge the photoreceptor with an electrostatic charge of one polarity and to project a preselected off-focus image of the subject on the photoreceptor prior to charging the photoreceptor with an electrostatic charge of opposite polarity and again to project a preselected off-focus image of the subject on the photoreceptor after the charging step.

29. An apparatus as claimed in claim 27 in which said one polarity is negative and said opposite polarity is positive.

30. An apparatus as claimed in claim 27 in which said one polarity is positive and said opposite polarity is negative.

31. An apparatus as claimed in claim 27 in which the substrate of the photoreceptor and the electrode are transparent, and including means to project the image both on the photoreceptor and on the electrode.

32. An apparatus as claimed in claim 27 including means to charge the photoreceptor with an electrostatic charge of one polarity and to project the preselected off-focus image of the subject on the receptor during the first projection of the image and again during the second projection of the image together with a booster potential of the said opposite polarity.

* * * * *